US006178298B1

(12) United States Patent
Nagatani

(10) Patent No.: US 6,178,298 B1
(45) Date of Patent: Jan. 23, 2001

(54) IMAGE FORMING MANAGEMENT APPARATUS THAT MANAGES THE NUMBER OF IMAGE FORMATIONS BY IMAGE FORMING APPARATUS

(75) Inventor: Kentaro Nagatani, Toyohashi (JP)

(73) Assignee: Minolta Co., Ltd., Osaka (JP)

( * ) Notice: Under 35 U.S.C. 154(b), the term of this patent shall be extended for 0 days.

(21) Appl. No.: 09/158,808

(22) Filed: Sep. 22, 1998

(30) Foreign Application Priority Data

Sep. 22, 1997 (JP) ..... 9-257016

(51) Int. Cl.[7] ..... G03G 21/02
(52) U.S. Cl. ..... 399/79
(58) Field of Search ..... 399/79, 80, 43, 399/81

(56) References Cited

U.S. PATENT DOCUMENTS 5,608,494 * 3/1997 Ogura et al. ..... 399/346
5,903,801 * 5/1999 Nakamura ..... 399/79

FOREIGN PATENT DOCUMENTS 59-091569 5/1984 (JP) .
61-032862 2/1986 (JP) .
3-255466 11/1991 (JP) .
3-270463 12/1991 (JP) .
4-321061 11/1992 (JP) .
5-020470 1/1993 (JP) .

* cited by examiner

*Primary Examiner*—Robert Beatty
(74) *Attorney, Agent, or Firm*—Morrison & Foerster LLP

(57) ABSTRACT

The user inputs the section ID of the user section using the operator panel on a copying machine, for selecting receiver sections. In the receiver selection processing, the section numbers and the names of the prospective receiver sections that have been stored in the memory in relation to the user section ID are displayed in a list on the liquid crystal display unit of the operator panel. The user selects the receiver sections using the screen displayed on the liquid crystal display unit. When the copying operations are performed, the number of copying operations are counted for the selected receiver sections.

13 Claims, 16 Drawing Sheets

FIG. 5

α3

| | | | | | | | | |
|---|---|---|---|---|---|---|---|---|
| α31→ | REGISTERED SECTION AREA | 1 | 2 | 3 | 5 | 27 | ---------- | 0 (NOT USED) | 0 (NOT USED) |
| α32→ | YES/NO | YES | YES | NO | NO | YES | ---------- | NO | NO |
| α33→ | COUNT FLAG | 1 | 0 | 0 | 0 | 0 | | 0 | 0 |

IMAGE FORMING MANAGEMENT APPARATUS THAT MANAGES THE NUMBER OF IMAGE FORMATIONS BY IMAGE FORMING APPARATUS

This application is based on an application No. 95-257016 filed in Japan, the content of which is hereby incorporated by reference.

BACKGROUND OF THE INVENTION (1) Field of the Invention

The present invention relates to an image forming management apparatus that manages the number of image formations by image forming apparatus, for instance, a copying machine, for each group of user.

(2) Related Art

An image forming apparatus, such as a copying machine (hereinafter referred to as a "copying machine") used in a company or another such organization is often shared by a plurality of groups (for instance, sections). In this case, it is desirable to prohibit unauthorized persons from using the copying machine and to manage the number of copying operations by each of the sections that use the copying machine for cost management.

When using a conventional copying machine, the user inputs the identification number that is given to the section that the user belongs to (hereinafter, such a section will be called a "user section", and such an identification number is called a "user section ID (identification data)").

The control unit in the copying machine compares the user section ID that the user inputs with the identification numbers that are registered in the control unit in advance (hereinafter, such identification numbers will be called "registered section IDs"). Only when finding a registered section ID that corresponds to the input user section ID, the control unit allows the user to use the copying machine. After allowing the user to use the copying machine, the control unit adds the number of copying operations made by the user to the total for the user section corresponding to the user section ID. The control unit thus stores a total corresponding to each user section.

The person in charge of the copying machine regularly calculates a copying cost for each user section according to the totals and invoices the user sections.

When the user is allowed to use such a conventional copying machine, the copying machine stores the number of copying operations related to the user section corresponding to the input user section ID. As a result, it is undesirable to take copies for other sections using such a copying machine. This is because the cost of the copies for the other sections is included in the bill issued to the user section since the user has to input his/her own user section ID in order to be allowed to use the copying machine, even when taking copies for other sections (hereinafter, such a section will be called a "receiver section"). The number of copying operations is stored related to the user section corresponding to the input user section ID, so that it is naturally undesirable for the receiver of copies (the receiver section) and the section bearing the cost of the copies (the user section) to differ.

In order to avoid such a problem, when taking copies for receiver sections, the user may obtain the identification numbers of the receiver sections (hereinafter, the identification number of a receiver section is called a "receiver section ID") in advance and input the obtained identification numbers. In other words, the user may be allowed to use the copying machine for the receiver sections. This solution, however, is far from ideal. It is troublesome for the user to memorize and input each of the receiver section IDs. The greater the number of the receiver sections, the more troublesome such operations become.

It is also highly possible for the user to input the wrong receiver section ID by mistake. In other words, it is highly possible for the copying machine to count the number of copying operations for a receiver section for which the user never takes copies.

SUMMARY OF THE INVENTION

The object of the present invention is to provide an image forming management device that does not require the user to memorize and input receiver section IDs and does not count copying operations by mistake for a group for which the user never takes copies.

The above-mentioned object may be achieved by an image forming management apparatus that manages image formations by an image forming apparatus, including: a memory for storing (1) a plurality of identifiers each of which corresponds to a different group in a plurality of groups, and (2) a plurality of information that are related to one of the plurality of identifiers, each piece of information representing one group that differs from a group corresponding to a related identifier; an identifier reception unit for receiving input of an identifier; a display unit for displaying a plurality of information stored in the memory; a selection unit for selecting at least one piece of information from the plurality of pieces of information that the display unit displays; and a processor for having the display unit display a plurality of information that are stored in the memory and are related to the identifier received by the identifier reception unit, for receiving at least one piece of information selected with the selection unit among the plurality of pieces of information displayed by the display unit, for counting the number of image formations made by the image forming apparatus, and for storing the counted number in the memory relating to each group corresponding to each piece of information selected with the selection unit.

The object may be also achieved by an image forming apparatus, including: an image forming unit for forming an image on a recording sheet; a memory for storing (1) a plurality of identifiers each of which corresponds to a different group in a plurality of groups, and (2) a plurality of pieces of attached information that are related to one of the plurality of identifiers, each piece of attached information representing one group that differs from a group corresponding to a related identifier; an identifier reception unit for receiving input of an identifier; a display unit for displaying a plurality of pieces of attached information stored in the memory; a selection unit for selecting at least one piece of attached information from the plurality of pieces of attached information that the display unit displays; and a processor for having the display unit display a plurality of pieces of attached information that are stored in the memory and are related to the identifier received by the identifier reception unit, for receiving at least one piece of attached information selected with the selection unit among the plurality of pieces of attached information displayed by the display unit, for activating the image forming unit, for counting the number of image formations made by the image forming unit, and for storing the counted number in the memory relating to each group corresponding to each piece of attached information selected with the selection unit.

The object may be also achieved by an image forming management method that manages image formations by image forming apparatus, including: a first step for storing an identifier for each of a plurality of groups in a memory; a second step for storing a plurality of pieces of attached information related to an identifier for each identifier, each piece of attached information representing one group that differs from a group corresponding to a related identifier; a third step for receiving input of an identifier; a fourth step for displaying a plurality of pieces of attached information that are stored in the memory and are related to the received identifier on a display unit; a fifth step for receiving at least one piece of attached information from the plurality of pieces of attached information displayed on the display unit; a sixth step for having the image forming apparatus perform image formations; and a seventh step for counting a number of image formations by the image forming apparatus and for storing the counted number in the memory relating to each group corresponding to each piece of attached information received at the fifth step.

In the image forming management device, it is possible to register in advance the information representing the prospective receiver groups for which the user can take copies, to display the registered information, and to select receiver groups using the displayed information. As a result, it is not necessary for the user to memorize the IDs of the receiver groups. There is no possibility that the user inputs the ID of a wrong receiver group by mistake and that the number of copying operations is counted for a wrong receiver group.

In this specification, a "group" means a group of people, for instance, a division and a section in a company, or a person for which the number of image formations is managed.

BRIEF DESCRIPTION OF THE DRAWINGS

These and other objects, advantages and features of the invention will become apparent from the following description thereof taken in conjunction with the accompanying drawings which illustrate a specific embodiment of the invention. In the Drawings:

FIG. 5 shows a detail construction of the receiver section storage area;

DESCRIPTION OF THE PREFERRED EMBODIMENT

The embodiment of an image forming management device according to the present invention applied to an analogue monochrome copying machine (hereinafter, an analogue monochrome copying machine will be called a "copying machine") will be explained below.

(1) Overall Structure of Copying Machine

Figure 1:
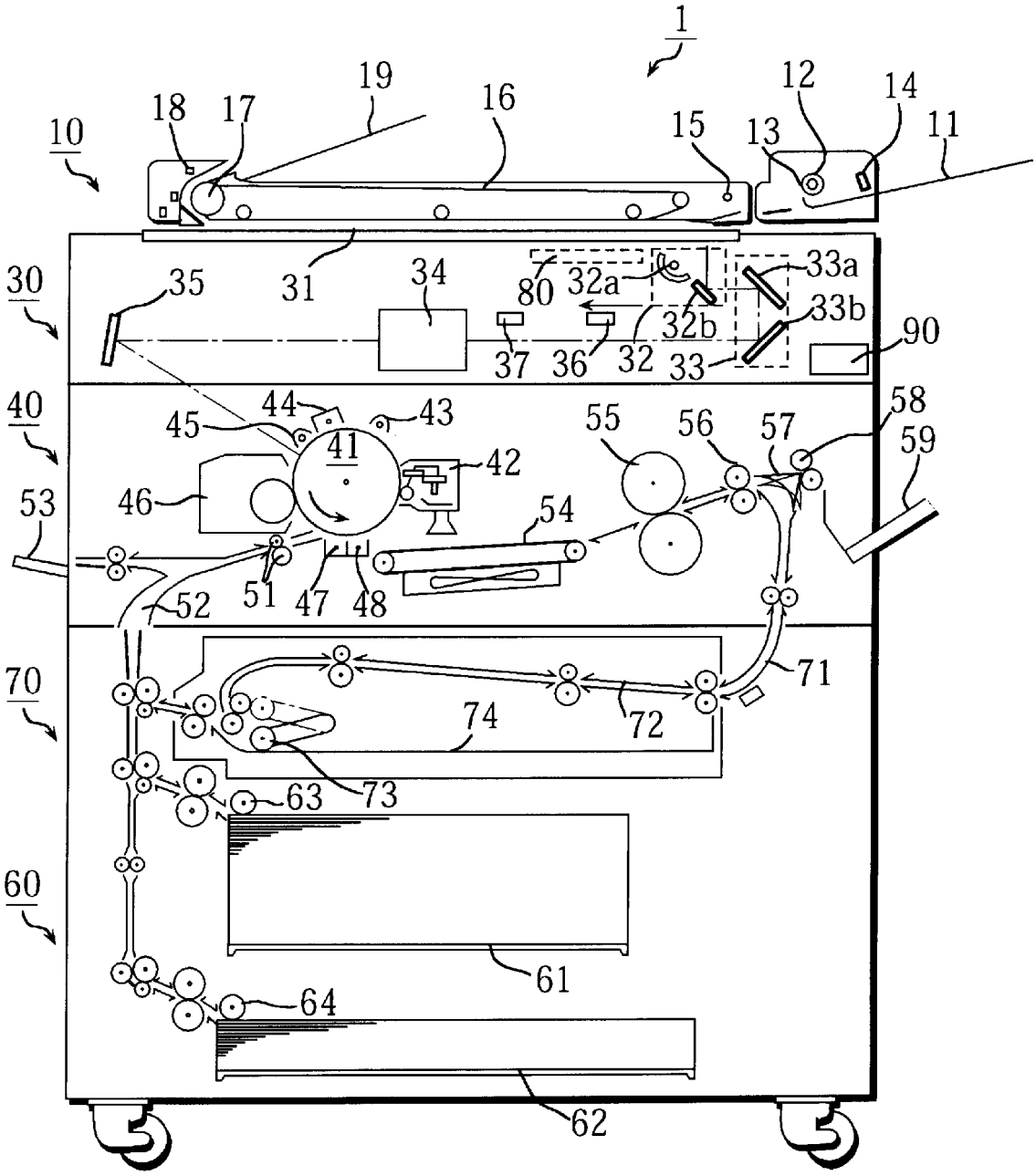
FIG. 1 shows an overall construction of the copying machine.

FIG. 1 shows an overall structure of copying machine 1.

The copying machine 1 includes an automatic document feeder 10 for feeding originals one after another, an image reading optical system 30 for optically reading the image on an original, an image forming unit 40 for reproducing the read image on a recording sheet S such as a copy paper, a paper feed unit 60 for feeding recording sheets S, a paper re-feed unit 70 for feeding a recording sheet S on which the image on an original is reproduced, a control panel 80 for inputting a user section ID and a copy mode such as a magnification ratio or a copy density, and a control unit 90.

The automatic document feeder 10 automatically sets originals one after another on an original glass plate 31. The automatic document feeder 10 includes an original feed tray 11, an original feed roller 12, a drive motor 13 for rotating the original feed roller 12, an original set detection sensor 14 for detecting whether an original is on the original feed tray 11, an original feed detection sensor 15 for detecting the original that the original feed roller 12 has fed, an original transport belt 16 for transporting an original fed by the original feed roller 12, a drive motor 17 for driving the original transport belt 16, an original exit detection sensor 18, and an original exit tray 19.

The image reading optical system 30 scans the original on the original glass plate 31. The image reading optical system 30 includes a scanner 32 that a scanner motor (not shown in FIG. 1) moves in the subscanning direction indicated by an arrow in FIG. 1 at a moving speed of V/N ("V" represents the peripheral velocity of a photoconductive drum 41, and "N" represents a magnification ratio), a slider 33 that moves in the same direction as the scanner 32 at a speed of V/(2·N), a condenser lens 34 that moves to the place according to the magnification ratio with maintaining the optical conjugate relationship, a reflecting mirror 35, a home position detection sensor 36 for detecting the scanner 32 set at the home position, and a detection sensor 37 for detecting the original set at the original read position where an original is read.

The scanner 32 includes an exposure lamp 32*a* for projecting light onto the original and a reflecting mirror 32*b* for reflecting the light reflected by the original in the direction parallel to the original glass plate 31. The slider 33 includes reflecting mirrors 33*a* and 33*b* for reflecting the light reflected by the reflecting mirror 32*b* in the opposite direction parallel to the reflected light.

The image forming unit 40 reproduces the image read by the image reading optical system 30 on a recording sheet S, and includes the photoconductive drum 41. Around the photoconductive drum 41, the image forming unit 40 includes a cleaner 42, an eraser lamp 43, a sensitizing charger 44, a between-image eraser lamp 45, a developing unit 46, a transfer charger 47, and a separating charger 48.

On the upstream side from which recording sheets S are transported, the image forming unit 40 includes a timing roller 51, a paper transport path 52, and a manual bypass tray 53. On the downstream side to which recording sheets S are transported, the image forming unit 40 includes a paper transport belt 54, a fixing unit 55, a paper transport roller 56, a switching lever 57, a paper exit roller 58, and a paper tray 59.

The paper feed unit 60 feeds recording sheets S of predetermined sizes. The paper feed unit 60 includes two paper cassettes 61 and 62 each of which holds a pile of recording sheets S of a predetermined size, and pick-up rollers 63 and 64 each of which picks up a recording sheet S held in the paper cassettes 61 and 62, respectively, and feeds the recording sheet S to the paper transport path 52.

When two copying operations create a synthesized copy to form two images on one side of a recording sheet S, or a two-sided copy to form an image on each side of a recording sheet S, the paper re-feed unit 70 feeds a recording sheet S on which an image has been reproduced. The paper re-feed unit 70 has paper re-transport paths 71 and 72 provided with a plurality of transport rollers, a paper re-feeding roller 73, and a paper re-feed tray 74.

After allowed to use the copying machine 1 with predetermined operations that will be explained later, the user sets originals on the original feed tray 11 and presses the print key 84 on the control panel 80 (refer to FIG. 2). When the user presses the print key 84, the original feed roller 12 is driven according to an ADF (Automatic Document Feeder) start signal transmitted from the CPU 91 in the control unit 90 (refer to FIG. 3), and an original on the original feed tray 11 is fed toward the original glass plate 31. When the original feed detection sensor 15 detects the original, the original transport belt 16 is driven to transport the original to the original read position on original glass plate 31. When detecting that the original is placed at the original read position, the detection sensor 37 sends an original setting signal to stop transporting the original.

The scanner 32 scans the original at the original read position in the subscanning direction. The light projected by the exposure lamp 32*a* onto the original is reflected by the original. After further reflected by the reflecting mirrors 32*b*, 33*a*, and 33*b*, the reflected light is sent through the condenser lens 34 and reflected by the reflecting mirror 35. The reflected light is finally sent to and exposes the surface of the photoconductive drum 41. After the scan and the exposure is repeated the number of times corresponding to the required number of copying operations, the original transport belt 16 is driven to transport the scanned original to the original exit tray 19.

The scanner 32 is reset to the home position, and the next original on the original feed tray 11 is transported to the original read position on the original glass plate 31. Until all of the originals on the original feed tray 11 are fed to the original read position, the process from the scan to the exposure is repeated.

Before the exposure of photoconductive drum 41 by the reflected light, the operations explained below are 15 performed. The cleaner 42 removes the residual toner on the surface of the photoconductive drum 41. The eraser lamp 43 neutralizes any surface potential remaining on the surface of the photoconductive drum 41. The sensitizing charger 44 charges the entire surface of the photoconductive drum 41. When necessary, the between-image eraser lamp 45 further neutralizes any surface potential on part of the surface of the photoconductive drum 41. After the operations, the photoconductive drum 41 is exposed by the reflected light, and an electrostatic latent image is formed on the surface. When toner is supplied from the developing unit 46, the electrostatic latent image is developed.

Simultaneously to the exposure of the photoconductive drum 41 and the development process, a recording sheet S of a required size is supplied from the paper cassette 61 or 62, or the manual bypass tray 53 via the timing roller 51 and touches the surface of the photoconductive drum 41 on the bottom. The toner on the surface of the photoconductive drum 41 is attracted onto the surface of the recording sheet S by the static electricity on transfer charger 47. The recording sheet S is separated from the surface of the photoconductive drum 41 by the separating charger 48 and is fed to the fixing unit 55.

The developed image on the surface of the recording sheet S is not fixed. In other words, the toner on the surface of the recording sheet S easily comes off when touched. The fixing unit 55 applies heat and pressure to the toner and fuses the toner into the recording sheet S in order to fix the developed image to the recording sheet S.

When a normal one-sided copy, a synthesized copy, or a two-sided copy is finished, the left side of the switching lever 57 is lowered to transport a recording sheet S on which toner is fixed to the paper tray 59. When a synthesized copy or a two-sided copy is not finished, the left side of the switching lever 57 is raised.

When one copying operation is finished for a synthesized copy, the recording sheet S on which toner is fixed is transported to the paper re-feed tray 74 through the paper re-transport path 71 with the upper side of the recording sheet S down. The paper re-feeding roller 73 is rotated to feed the transported recording sheet S to the transfer position of the photoconductive drum 41 through the paper transport path 52 so that the upper side of the recording sheet S touches the photoconductive drum 41. Another image may be developed on the upper side of the recording sheet S in this manner.

When one copying operation is finished for a two-sided copy, a recording sheet S is transported to the paper re-feed tray 74 through the paper re-transport paths 71 and 72 with the upper side of the recording sheet S up. The paper re-feeding roller 73 is rotated to feed the transported recording sheet S to the bottom of the photoconductive drum 41, where toner is transferred to a recording sheet S, through the paper transport path 52 so that the under side of the recording sheet S touches the photoconductive drum 41. An image may be formed on the under side of the recording sheet S in this manner.

Figure 2:
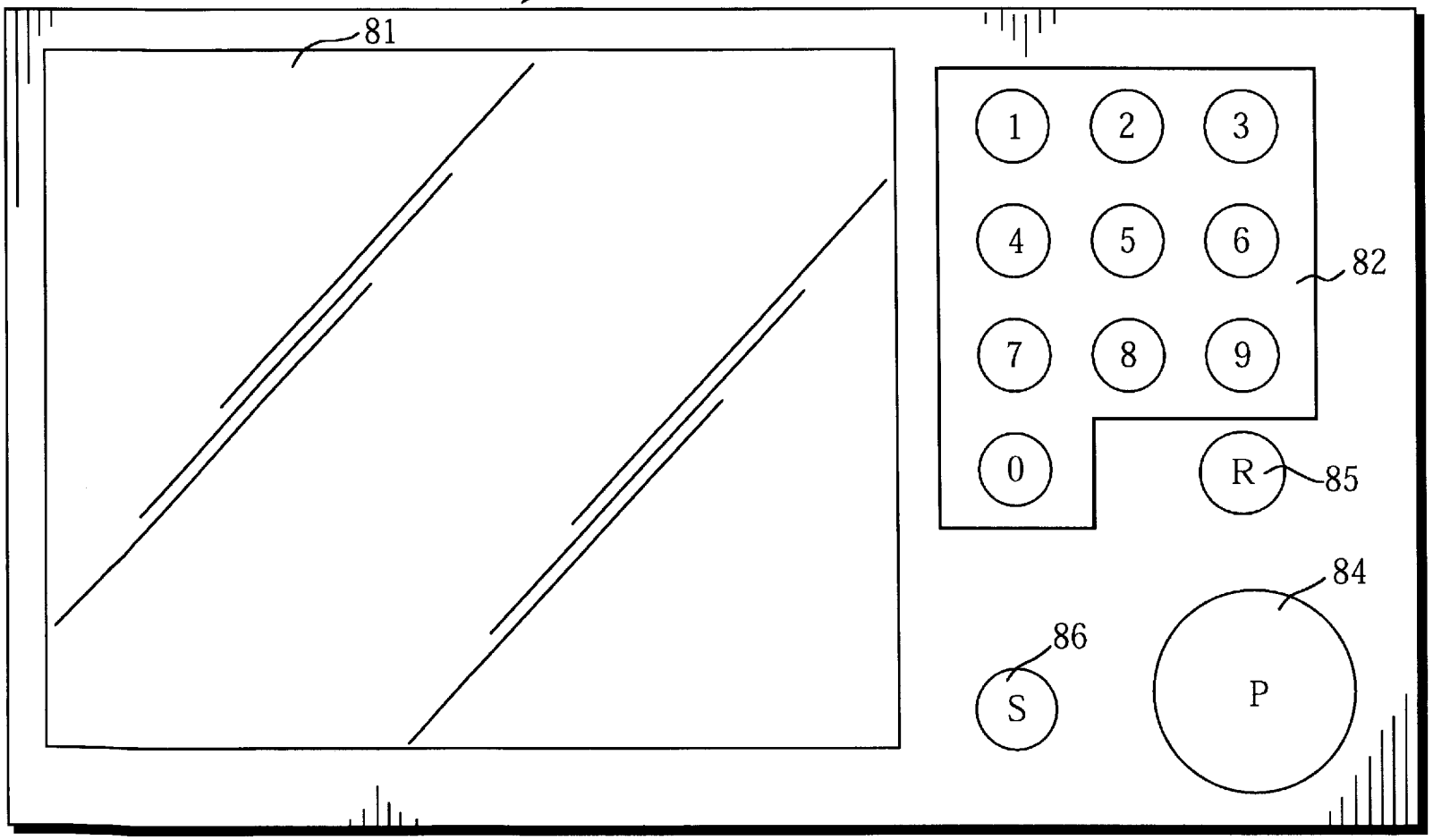
FIG. 2 shows a construction of the operator panel of the copying machine.

On the front side of the image reading optical system 30, the control panel 80 shown in FIG. 2 is provided where the user is easy to operate.

The control panel 80 includes a liquid crystal display unit 81 that is a liquid crystal display (hereinafter, called an "LCD" ) on which a touch panel is provided, a 10-key pad 82 for inputting the number of copies to be made, a print key 84 for instructing to start copying operations, a panel reset key 85 for resetting copy conditions to the standard, and a stop key 86 for stopping copying operations. On the LCD, a variety of messages such as the messages instructing the user to input a section ID and to select a copying mode, and selection keys are displayed. The user reads the displayed messages and inputs the user section ID, a receiver section number, a copy mode, and the like.

(2) Construction of Control Unit 90

Figure 3:
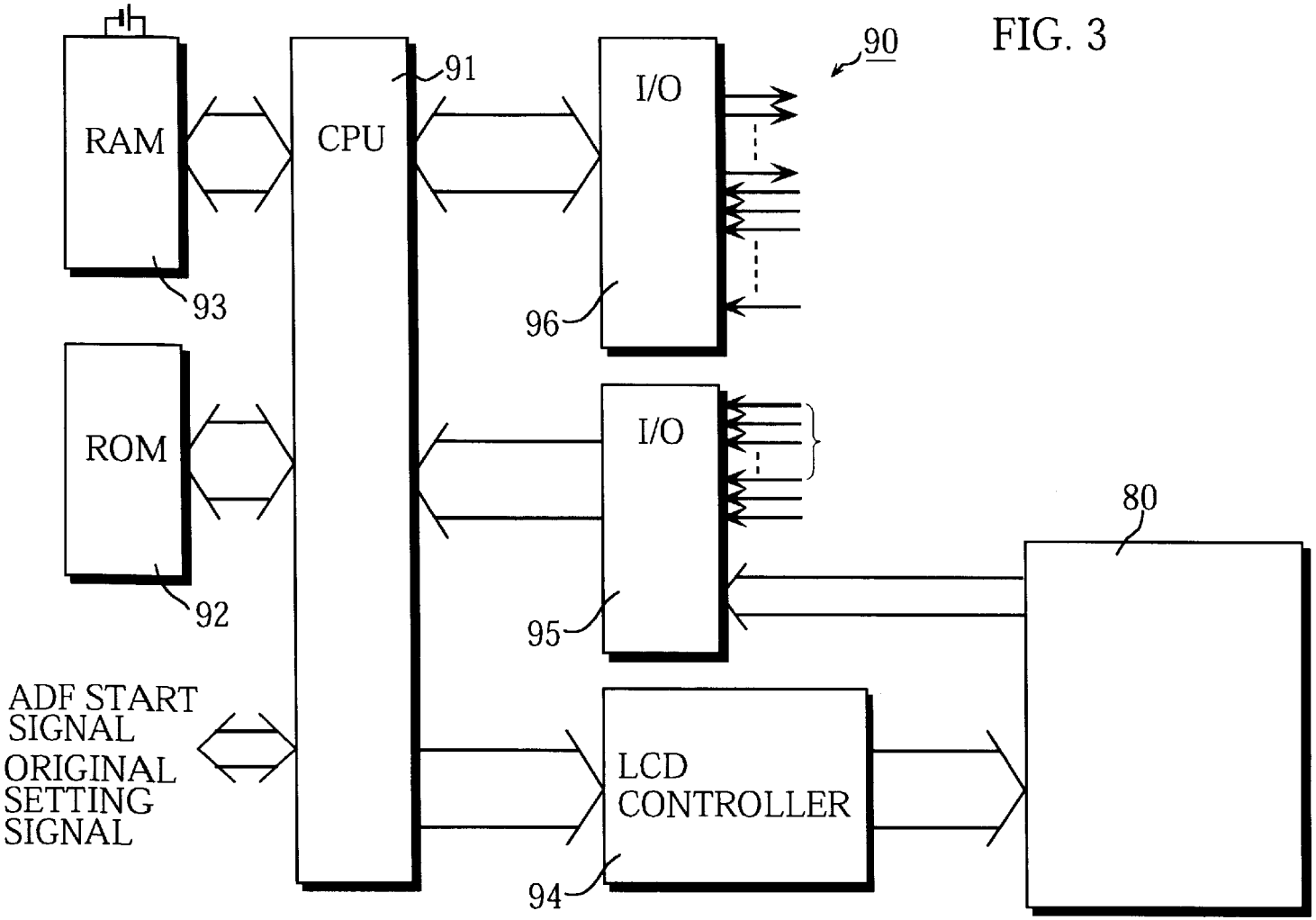
FIG. 3 is a block diagram showing a construction of the control unit and the peripheral components.

FIG. 3 is a block diagram showing a construction of the control unit 90 and the peripheral components.

As shown in FIG. 3, the control unit 90 is composed of a CPU 91. To the CPU 91, a ROM 92, a RAM 93 that is backed up using a battery, an LCD controller 94, and I/O ports 95 and 96 are connected.

The ROM 92 stores a program for section management, a control program for scanning and image formations, a control program for section management in which the number of copying operations for each section is managed, and display data to be displayed on the LCD.

The RAM 93 includes a temporary RAM 93*a*, a main RAM 93*b* (refer to FIG. 4), and a work area for storing instructions from the user and the condition of each unit of the copying machine 1 when a program is executed.

The LCD controller 94 has the liquid crystal display unit 81 display screens according to the display data output from the CPU 91.

The I/O port 95 transmits the user instructions input through the touch panel on the liquid crystal display unit 81 on the control panel 80, the 10-key pad 82, the print key 84, the panel reset key 85, and the stop key 86 to the CPU 91.

The I/O port 96 outputs drive signals to a motor, a solenoid, and a charger according to the signal from the CPU 91, and transmits the condition signals from the sensors to the CPU 91.

The CPU 91 controls the operations and the timing of image reading and image formations according to the detection results output from the sensors so that smooth copying operations are realized.

Figure 4:
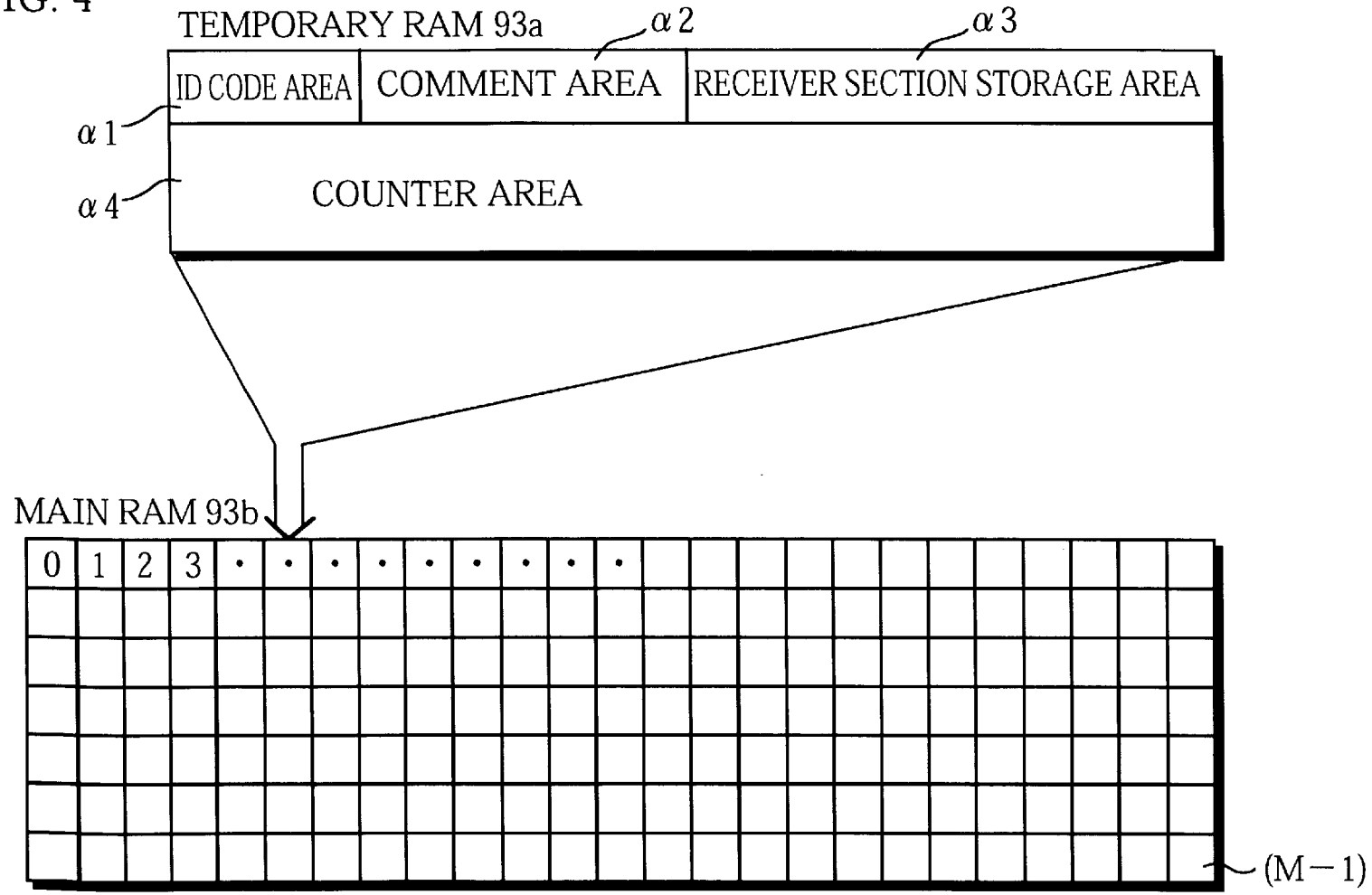
FIG. 4 shows a construction of a memory area on the RAM in the control unit.

FIG. 4 shows part of the internal arrangement of the RAM 93.

The temporary RAM 93*a* is temporarily used when necessary, such as when a section ID is registered and when a receiver section is registered. The temporary RAM 93*a* includes an ID code area α1, a comment area α2, a receiver section storage area α3, and a counter area α4. The ID code area α1 stores a user section ID. The comment area α2 stores, for instance, the name of the user section. The receiver section storage area α3 stores the section numbers of receiver sections for which the user can take copies. The counter area α4 stores the counted value of copying operations for the user section.

The main RAM 93*b* consists of M (for instance, M=1000) storage areas. The construction of a storage area in the main RAM 93*b* is the same as in the temporary RAM 93*a*. The address of each storage area in the main RAM 93*b* corresponds to a different section number.

The storage area in the main RAM 93*b* corresponding to the section number "0" is given to the management section of the copying machine 1 in advance. In the main RAM 93*b*, each of the storage areas corresponding to the section numbers "1" to "M−1" is freely selected by a section that uses the copying machine 1. The content in the temporary RAM 93*a* is stored in the storage areas that correspond to the section numbers have selected.

FIG. 5 shows a detail construction of the receiver section storage area α3.

As shown in FIG. 5, the receiver section storage area α3 includes a registered section area α31, a "yes/no" area α32, and a count flag area α33. The registered section area α31 stores a plurality of the section numbers of the sections for which the user may take copies. The yes/no area α32 stores the selection results showing whether the user takes copies for the sections stored in the area α31. The count flag area α33 stores the count-up flag that indicates the section for which the number of copying operations is counted up.

The section number of a section corresponds to the storage area address of the section, so that it is possible to access the storage area of a receiver section using the section number of the receiver section. As a result, it is possible to store the number of copying operations by the user for a receiver section as the number of copying operations of the receiver section.

(3) Control Operations by Control Unit 90

The control operations by the control unit 90 will be explained below with reference to the flowcharts.

Figure 6:
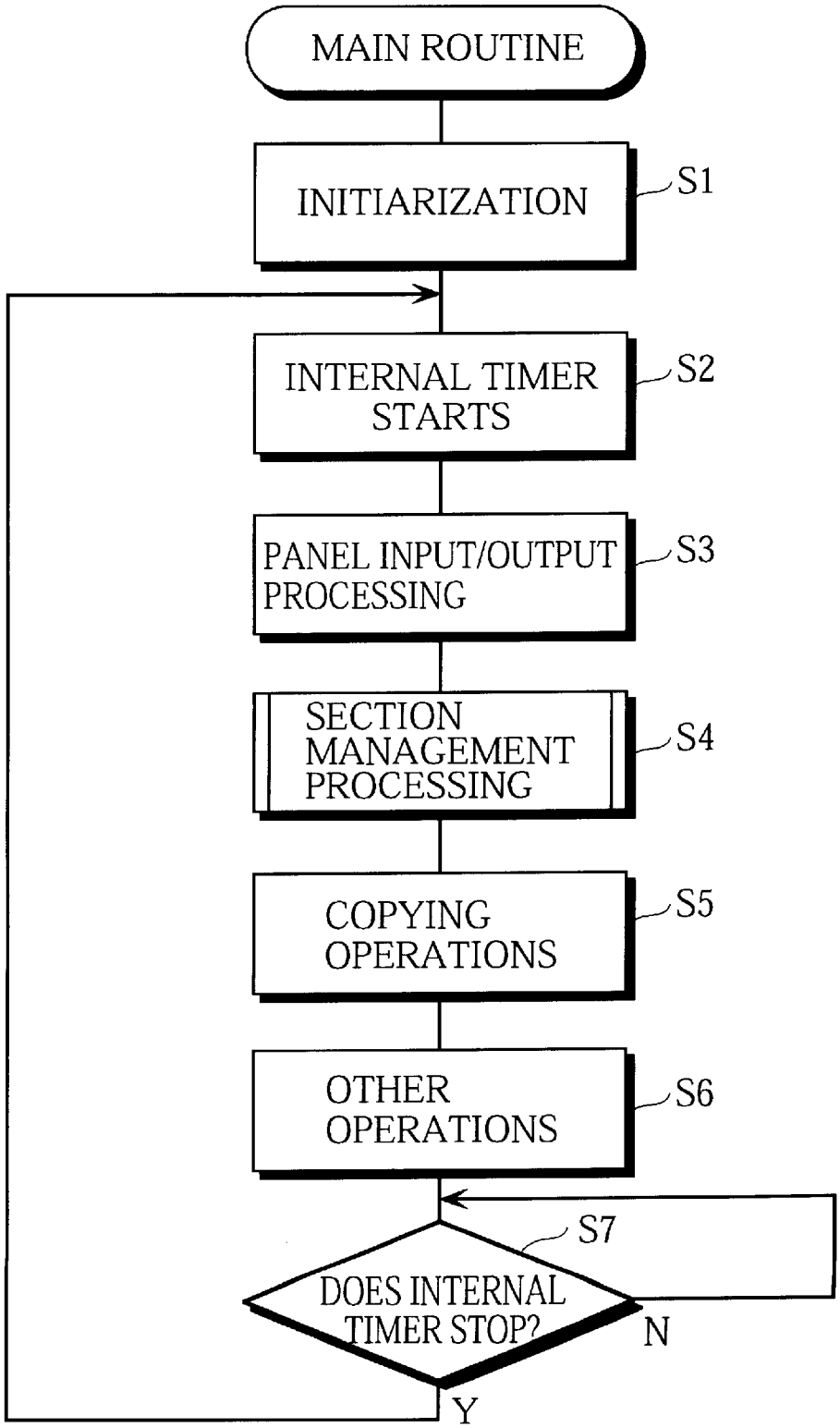
FIG. 6 is a flowchart showing the main routine of the process by the control unit.

FIG. 6 is a flowchart showing the main routine performed by control unit 90.

When the power of the copying machine 1 is turned on, the CPU 91 reads out the initialization program that the ROM 92 stores and initializes, for instance, the work area in RAM 93 (Step S1). The CPU 91 has an internal timer start timing to monitor the main routine is performed in a predetermined period of time (Steps 2 and 7)

After the internal timer starts timing, panel input/output processing (Step S3), section management processing (Step S4), copying operations (Step S5), and other operations (Step S6) are performed in order. In the panel input/output processing, the user inputs instructions using keys on the control panel 80, and messages and selection keys displayed on the liquid crystal display unit 81. In the section management processing, section IDs are accepted and other operations for section management are performed. In the copying operations, copying operations are performed in accordance with the set copy mode. In the other operations, for instance, communication with another CPU (not illustrated) is performed.

The panel input/output processing (Step S3), the copying operations (Step S5), and other operations (Step S6) are related to general well-known copying operations. In this specification, the section management processing peculiar to the present invention will be described in detail.

Figure 7:
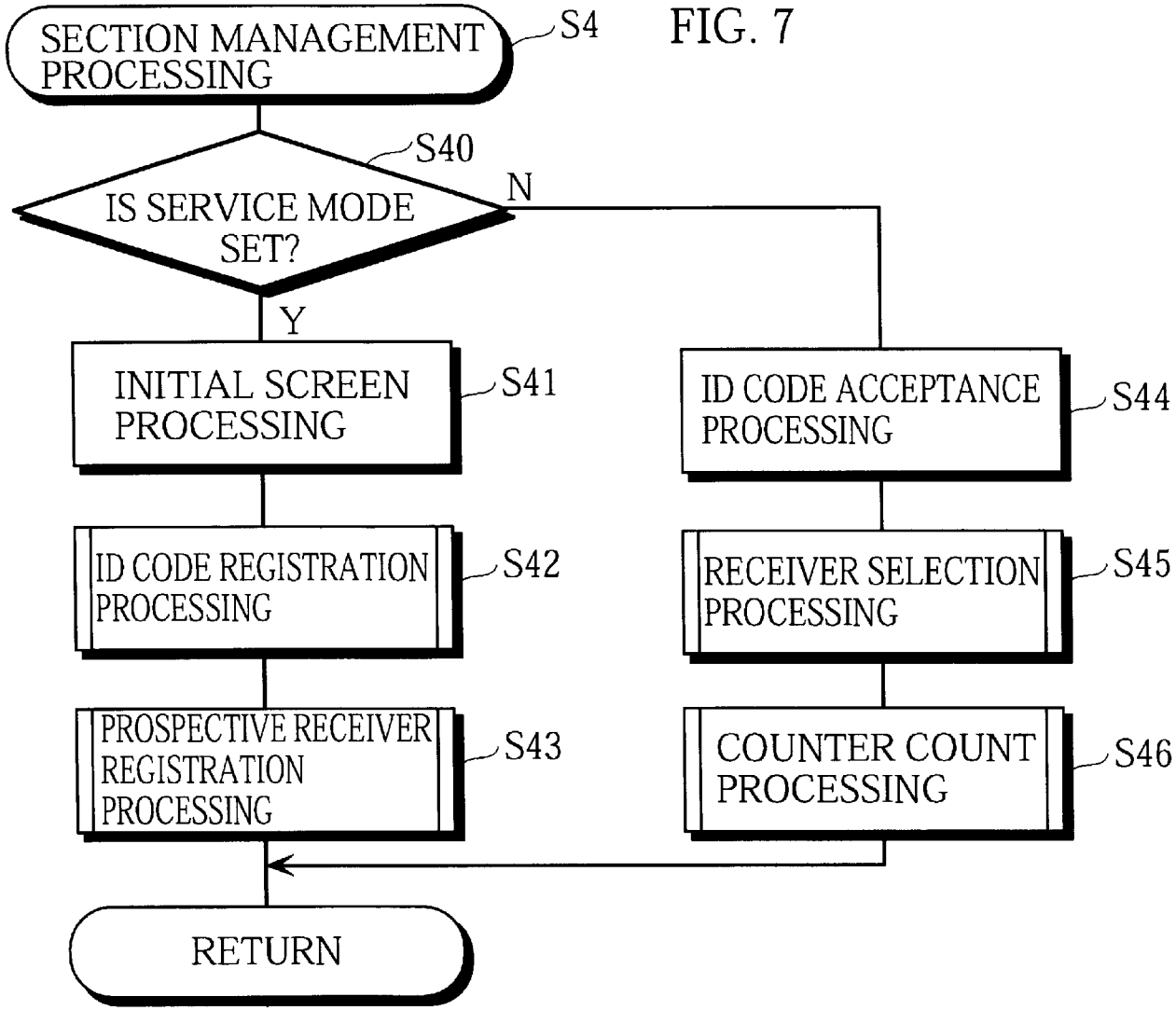
FIG. 7 is a flowchart showing the subroutine of the section management processing (Step S4) in FIG. 6.

FIG. 7 is a flowchart showing the subroutine of the section management processing (Step S4) in FIG. 6.

The CPU 91 judges whether a service mode is set (Step S40). The service mode is set when the user inputs a specific code using the 10-key pad 82. At Step S40, hen the specific code is input, the CPU 91 judges that the service mode is set.

When judging that the service mode is set, the CPU 91 performs initial screen processing (Step S41). The CPU 91 has the liquid crystal display unit 81 display the service mode initial screen shown in FIG. 8, and performs ID code registration processing (Step S42) for accepting the input from the manager of the copying machine 1 and registering section IDs. The CPU 91 performs prospective receiver registration processing (Step S43) for registering the prospective receivers of copies. The process returns to the main routine.

Figure 8:
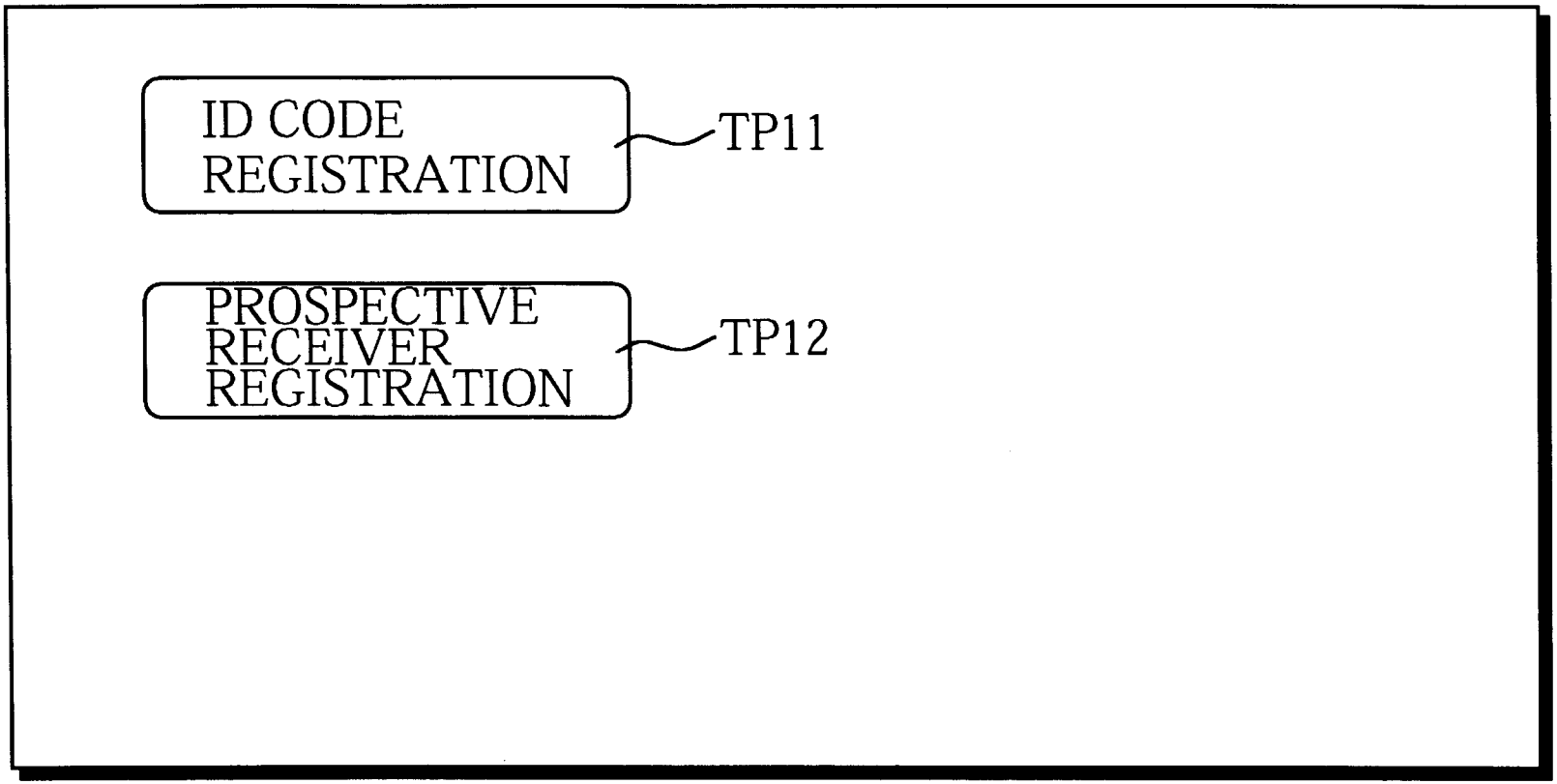
FIG. 8 shows the service mode initial screen displayed on the liquid crystal display unit of the operator panel of the copying machine.

As shown in FIG. 8, on the service mode initial screen, an "ID code registration" key TP11 and a "prospective receiver registration" key TP12 are displayed. The "ID code registration" key TP11 is used for registering the section IDs necessary to section management and the "prospective receiver registration" key TP12 is used for registering in advance the prospective receiver sections for which the user can take copies.

Figure 9:
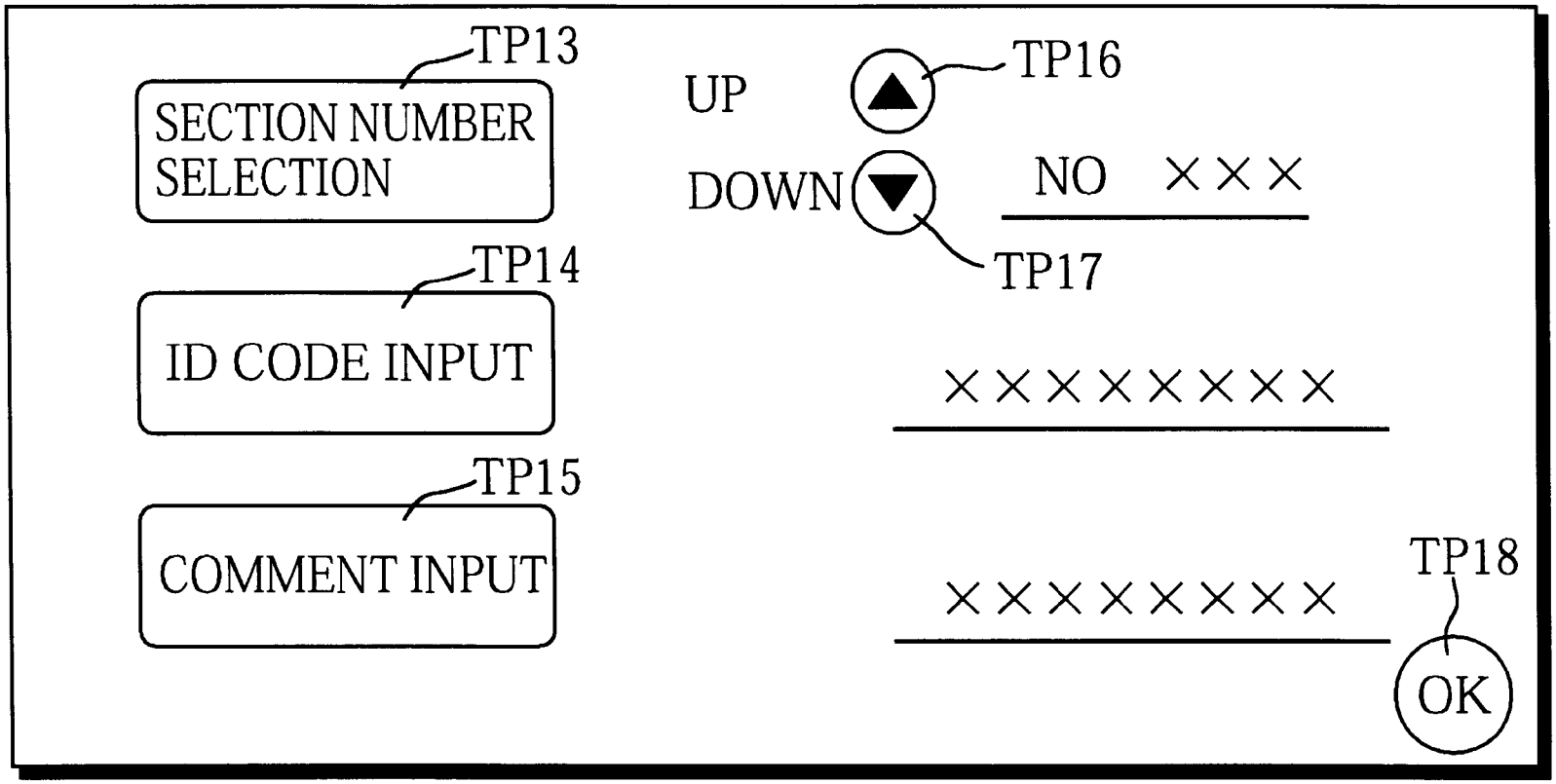
FIG. 9 shows the ID registration screen displayed on the liquid crystal display unit of the operator panel of the copying machine.

When the manager presses the "ID code registration" key TP11 on the service mode initial screen, the screen switches to the ID code registration screen shown in FIG. 9. In the ID code registration processing (Step S42), the manager of the copying machine 1 uses the ID code registration screen.

On the ID code registration screen, a "section number selection" key TP13, an "ID code input" key TP14, a "comment input" key TP15, an "up" key TP16, a "down" key TP17, and an "OK" key TP18 are displayed. The "section number selection" key TP13 is used for selecting the section number corresponding to a section the section IDs of which is to be registered. The "ID code input" key TP14 is used for registering a section ID. The "comment input" key TP15 is used for inputting a comment on the section the section ID of which is to be registered. For instance, the name of a section is input so that the section may be easily identified. The "up" key TP16 and the "down" key TP17 are used for scrolling the section numbers of the sections one by one. The "OK" key TP18 is used for registering the input section ID and comment on the storage areas in the main RAM 93*b* corresponding to the selected section number.

Figure 10:
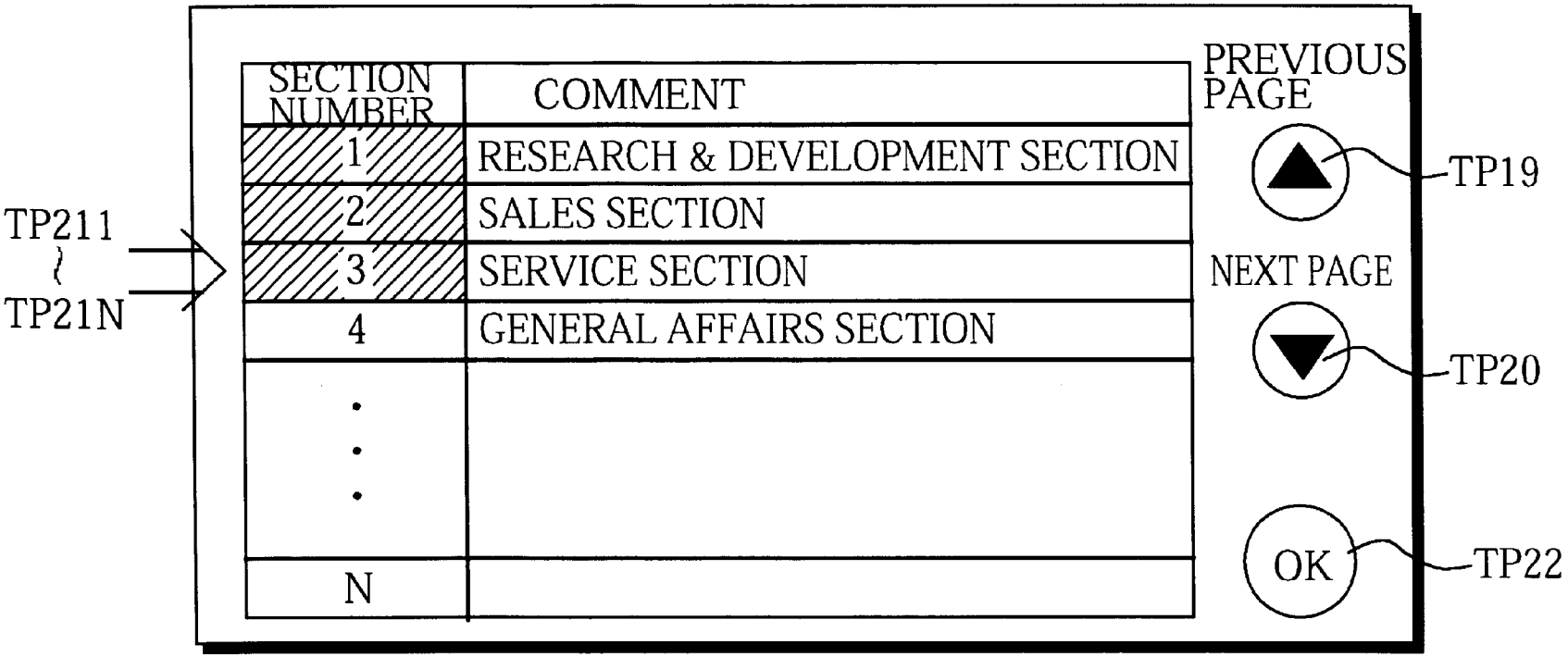
FIG. 10 shows the prospective receiver registration screen displayed on the liquid crystal display unit of the operator panel of the copying machine.

When the manager presses the "prospective receiver registration" key TP12 on the service mode initial screen, the screen switches to the prospective receiver registration screen shown in FIG. 10. In the prospective receiver registration processing (Step S43), the manager of the copying machine 1 uses the prospective receiver registration screen.

While M sections may be managed using the copying machine 1, M sections may not be displayed on the liquid crystal display unit 81 at once. N sections are displayed on the liquid crystal display unit 81 at once and M sections may be displayed in order by scrolling.

On the prospective receiver registration screen, "section number" keys TP211 to TP21N, a "previous page" key TP19, a "next page" key TP20, and an "OK" key TP22 are displayed. The "section number" keys TP211 to TP21N correspond to the section numbers and are used for selecting sections as prospective receiver sections. The "previous page" key TP19 and the "next page" key TP20 are used for scrolling N (for instance, 10) section numbers and the corresponding comments backward and forward. The "OK" key TP22 is used for confirming the prospective receiver sections selected by the "section number" keys TP211 to TP21N.

In FIG. 7, when the service mode is not set at Step S40, the CPU 91 performs ID code acceptance processing (Step S44) for accepting the input of an ID code by the user. The CPU 91 has the liquid crystal display unit 81 display the ID code input screen shown in FIG. 11.

Figure 11:
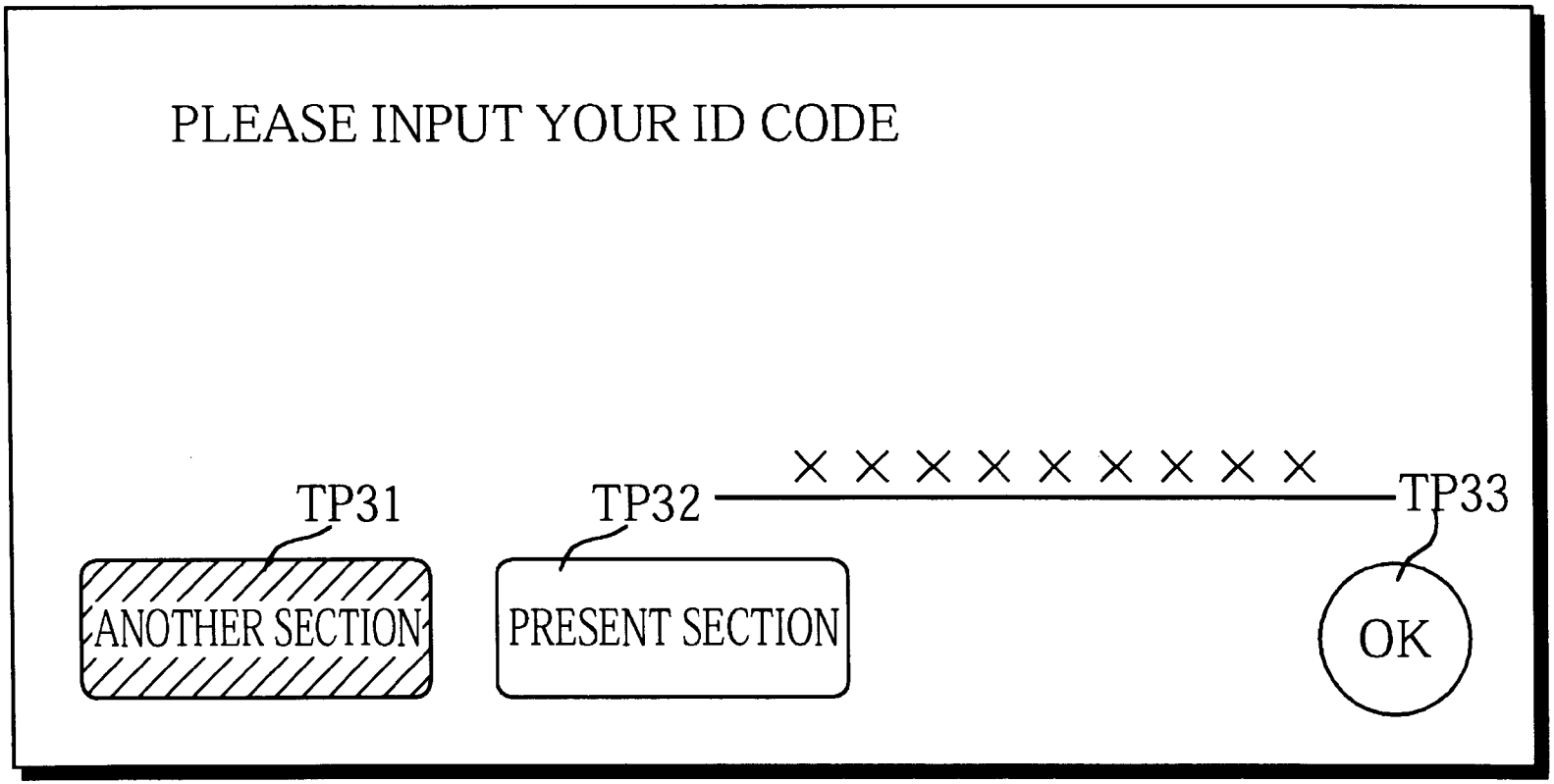
FIG. 11 shows the ID input screen displayed on the liquid crystal display unit of the operator panel of the copying machine.

As shown in FIG. 11, on the ID code input screen, the message "Please input your ID code", an "another section" key TP31, a "present section" key TP32, and an "OK" key TP33 are displayed. The "another section" key TP31 is pressed when the user takes copies for another section. The "present section" key TP32 is pressed when the user takes copies only for the user section. The "OK" key TP33 is used for confirming the input section ID and confirming whether the user takes copies for another section. When taking copies, the user inputs the user section ID, and presses the "another section" key TP31 or the "present section" key TP32.

When the user inputs the user section ID and presses the "OK" key TP33, the CPU 91 searches for the storage area that stores the same section ID in the main RAM 93*b*. When finding the storage area, the CPU 91 allows the user to use the copying machine 1 and transfers the contents of the storage area to the temporary RAM 93*a*. The CPU 91 performs receiver selection processing (Step S45) for selecting each receiver section and counter count processing (Step S46) for counting the number of copying operations for each selected receiver section. The process returns to the main routine.

When finding no storage area that stores the same section ID as the input user section ID in the main RAM 93*b*, the CPU 91 prohibits the user using the copying machine 1. In this case, Steps S45 and S46 in FIG. 7 are skipped.

Figure 12:
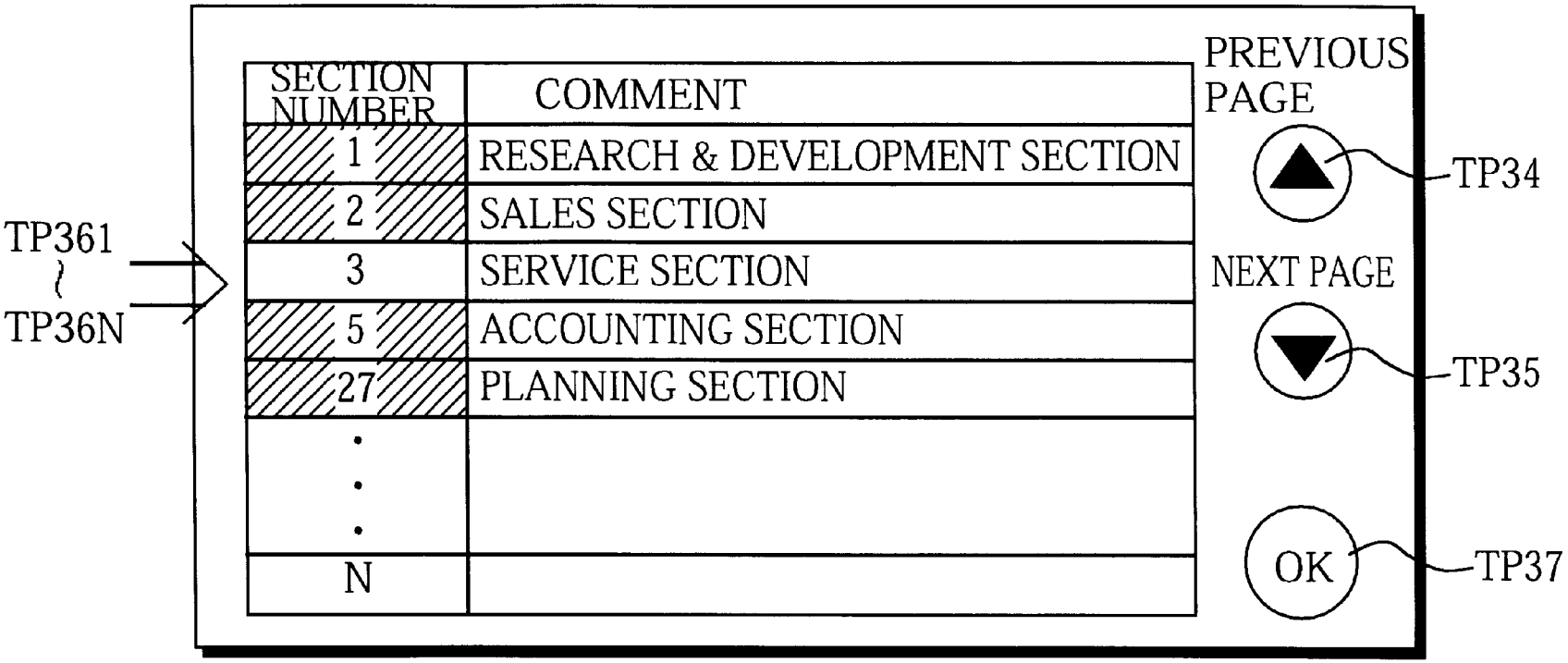
FIG. 12 shows the receiver selection screen displayed on the liquid crystal display unit of the operator panel of the copying machine.

When the ID code input screen in FIG. 11 is displayed, and when the user presses the "another section" key TP31 and the "OK" key TP33, the screen switches to the receiver selection screen shown in FIG. 12. In the receiver selection processing (Step S45), the user uses the receiver selection screen.

As shown in FIG. 12, on the receiver selection screen, "section number" keys TP361 to TP36N, a "previous page" key TP34, a "next page" key TP35, and an "OK" key TP37 are displayed. The "section number" key TP361 to TP36N correspond to the registered section numbers. The "previous page" key TP34 and the "next page" key TP35 are used for scrolling N section numbers and the corresponding comments backward and forward. The "OK" key TP37 is used for confirming the receiver sections selected by the "section number" keys TP361 to TP36N.

The section numbers represented by the "section number" keys TP361 to TP36N and the section names shown in the comment columns are the section numbers and the corresponding comments that the manager has selected at Step S43 when registering the prospective receiver sections. The section numbers and the comments corresponding to the sections that have not registered as prospective receiver sections are not displayed on the receiver selection screen.

The receiver selection screen prevents the user from selecting the sections for which the user never takes copies and searching through all the sections. In other words, the receiver selection screen enables the user to select receiver sections efficiently.

The ID code registration processing (Step S41), the prospective receiver registration processing (Step S43), the receiver selection processing (Step S45), and the counter count processing (Step S46) in FIG. 7 will be explained in detail with reference to figures.

Figure 13:
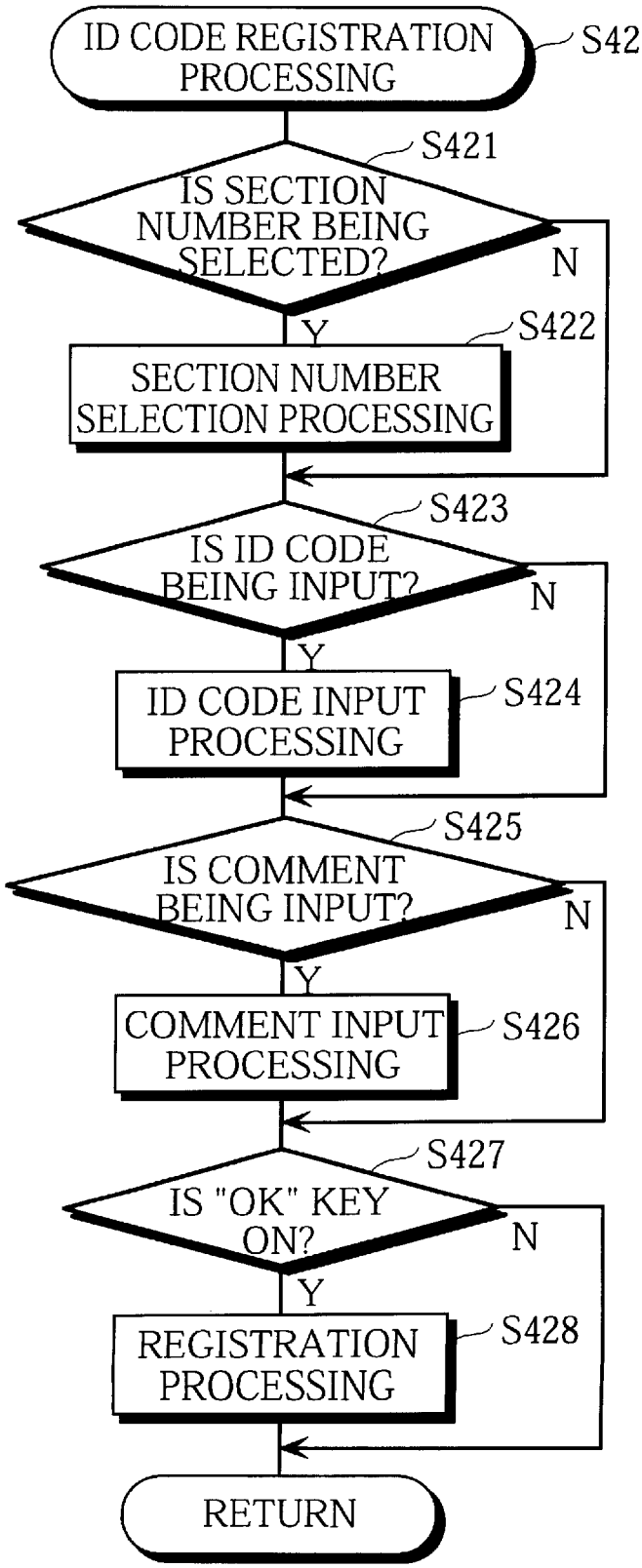
FIG. 13 is a flowchart showing the subroutine of the ID registration processing (Step S42) in FIG. 7.

FIG. 13 is a flowchart showing the subroutine of the ID registration processing (Step S42) in FIG. 7.

The CPU 91 judges whether the manager is selecting a section number by the ON or OFF of the "section number selection" key TP13 on the ID code registration screen shown in FIG. 9 (Step S421). If the manager is selecting a section number, section number selection processing (Step S422) is performed. In the section number selection processing, the manager selects a section number that has not been selected from the section numbers corresponding to the numbers of the storage areas in the main RAM 93*b* using the "up" key TP16 and the "down" key TP17. The selected section number is shown on the liquid crystal display unit 81.

If the manager is not selecting a section number at Step S421, Step S422 is skipped.

The CPU 91 judges whether the manager is inputting an ID code by the ON or OFF of the "ID code input key" TP14 (Step S423). If the manager is inputting an ID code, ID code input processing (Step S424) is performed. In the ID code input processing, the manager inputs the section ID for the section corresponding to the input section number using the 10-key pad 82. The CPU 91 accepts the input section ID, stores the section ID in the ID code area $\alpha 1$ in the temporary RAM 93*a* shown in FIG. 4, and has the liquid crystal display unit 81 display the section ID.

If the manager is not inputting an ID code at Step S423, Step S424 is skipped.

The CPU 91 judges whether the manager is inputting a comment by the ON or OFF of the "comment input" key TP15 (Step S425). If the manager is inputting a comment, comment input processing (Step S426) is performed. In the comment input processing, the 10-key pad 82 is used to input characters. The manager inputs the comments on the section corresponding to the input section number using the 10-key pad 82. The CPU 91 stores the input comment in the comment area α2 in the temporary RAM 93*a* shown in FIG. 4, and has the liquid crystal display unit 81 display the input comment.

If the manager is not inputting a comment at Step S425, Step S426 is skipped.

The CPU 91 judges whether the "OK" key TP18 is ON (Step S427). If the "OK" key TP18 is ON, registration processing (Step S428) is performed, and the process returns to Step S42. If not, the process skips Step S428 and returns to Step S42.

In the registration processing, the CPU 91 stores the section ID and the comment that have been temporarily stored in the temporary RAM 93*a* at Steps S424 and S426 in the storage area in the main RAM 93*b* corresponding to the section number selected at Step S422.

By repeating the subroutine, the section IDs of and the comments on the sections that use the copying machine 1 are registered in the storage areas in the main RAM 93*b*.

Figure 14:
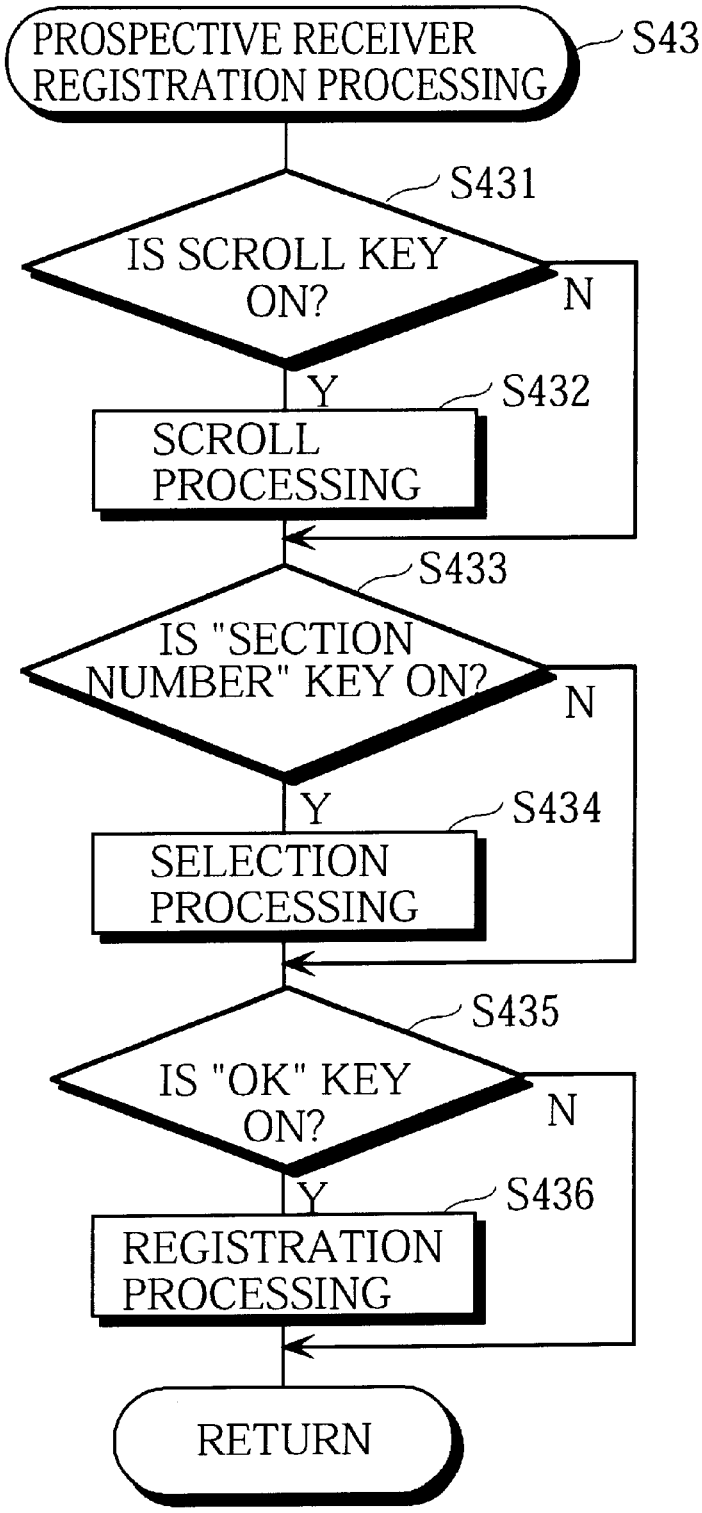
FIG. 14 is a flowchart showing the subroutine of the prospective receiver registration processing (Step S43) in FIG. 7.

FIG. 14 is a flowchart showing the subroutine of the prospective receiver registration processing (Step S43) in FIG. 7.

The CPU 91 judges whether the "previous page" key TP19 or the "next page" key TP20 on the prospective receiver registration screen shown in FIG. 10 is ON (Step S432). If the "previous page" key TP19 or the "next page" key TP20 is ON, scroll processing (Step S432) is performed. If not, Step S432 is skipped. In the scroll processing, the section numbers are scrolled by N so that M section numbers are displayed in order.

The CPU 91 judges whether at least one of the "section number" keys TP211 to TP21N is ON (Step S433). If at least one of the "section number" keys TP211 to TP21N is ON, selection processing (Step S434) is performed. If not, Step S434 is skipped. In the selection processing, the manager presses at least one of the "section number" keys TP211 to TP21N to select a prospective receiver section. The section number of each selected section is stored in the registered section area α31 in the receiver section storage area α3 in the temporary RAM 93*a*. The section number of each selected section is highlighted on the liquid crystal display unit 81 so that the manager finds that the corresponding section has been selected. In the storage area that is not occupied in the registered section area α31, "0" is written to show that the area is not used.

The CPU 91 judges whether the "OK" key TP22 is ON (Step S435). If the "OK" key TP22 is ON, registration processing (Step S436) is performed, and the process returns to Step S43. If not, the process skips Step S436 and returns to Step S43. In the registration processing, the CPU 91 stores the section number of each prospective receiver section that has been selected at Step S434 and is temporarily stored in the temporary RAM 93*a* in the storage area in the main RAM 93*b* corresponding to the section number that has been selected at Step S422.

A storage area in the main RAM 93*b* stores a user section ID that the user of a section inputs when using the copying machine 1 and the section numbers of prospective receiver sections related to the user section ID. The user section ID and each prospective receiver section for the user section are related and registered in the same storage area.

In the registration processing at Step S436, when registering the section number of each prospective receiver section for a section, it is possible for the manager to designate the section number of the section to which the section number of each selected prospective receiver section is related.

By repeating the subroutine, a set of the section ID of and the comment on a section and the corresponding prospective receiver section numbers are registered in the corresponding storage area in the main RAM 93*b* for each of the sections that use the copying machine 1.

Figure 15:
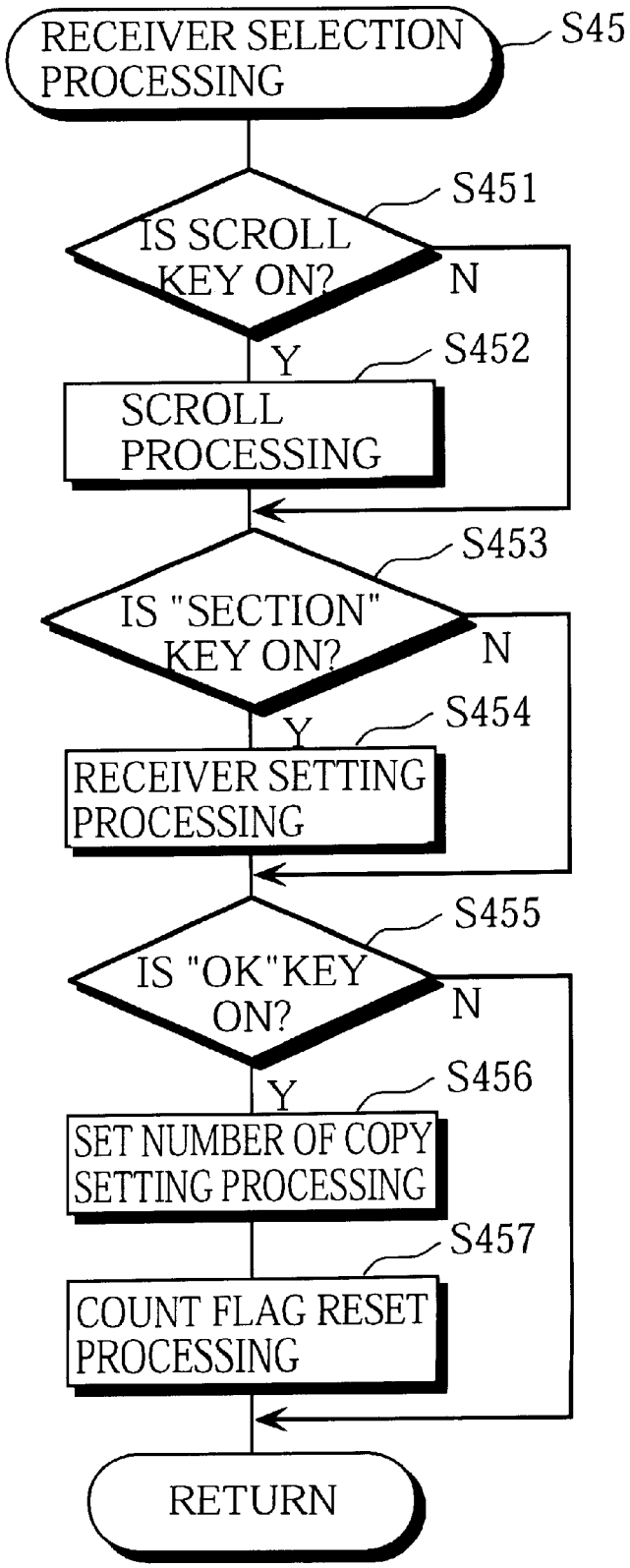
FIG. 15 is a flowchart showing the subroutine of the receiver selection processing (Step S45) in FIG. 7.

FIG. 15 is a flowchart showing the subroutine of the receiver selection processing (Step S45) in FIG. 7.

The CPU 91 judges whether the "previous page" key TP34 or the "next page" key TP35 is ON (Step S451). If the "previous page" key TP34 or the "next page" key TP35 is ON, scroll processing (Step S452) is performed. If not, Step S451 is skipped.

In the scroll processing, N prospective receiver sections are scrolled so that the prospective receiver sections that have been registered in advance in the registered section area α31 in the receiver section storage area α3 are displayed in order.

The CPU 91 judges whether at least one of the "section number" keys TP361 to TP36N is ON (Step S453). If at least one of the "section number" keys TP361 to TP36N is ON, receiver setting processing (Step S454) is performed. If not, Step S454 is skipped. In the receiver setting processing, the CPU 91 accepts the selection of each receiver section by the user. A "yes" is set in the yes/no area α32 (refer to FIG. 5) corresponding to the section number of each selected prospective receiver section in the temporary RAM 93*a*. The section number of each selected prospective receiver section is highlighted so that the user finds that the corresponding prospective receiver section has been selected.

In the yes/no area α32. corresponding to the section number of each not-selected prospective receiver section in the temporary RAM 93*a*, the default value "no" is kept.

The CPU 91 judges whether the "OK" key TP37 is ON (Step S455). If the "OK" key TP37 is ON, set number of copy setting processing (Step S456) for setting the number of the selected prospective receiver sections as the number of copies to be made for one original is performed. In the copying operations (Step S5 in FIG. 6), for one original, image forming processing is repeated the number of times corresponding to the number of copies to be made for one original.

Then, count flag reset processing (Step S457) is performed. In the count flag reset processing, a count flag is set for the receiver section corresponding to the section number the value of which is the smallest among the values of the section numbers of the selected receiver sections. The count flag indicates the receiver section for which the number of copying operations is counted. The process returns to Step S45. If the "OK" key TP37 is not ON at Step S455, the process skips Steps S456 and S457 and returns to Step S45.

Figure 16:
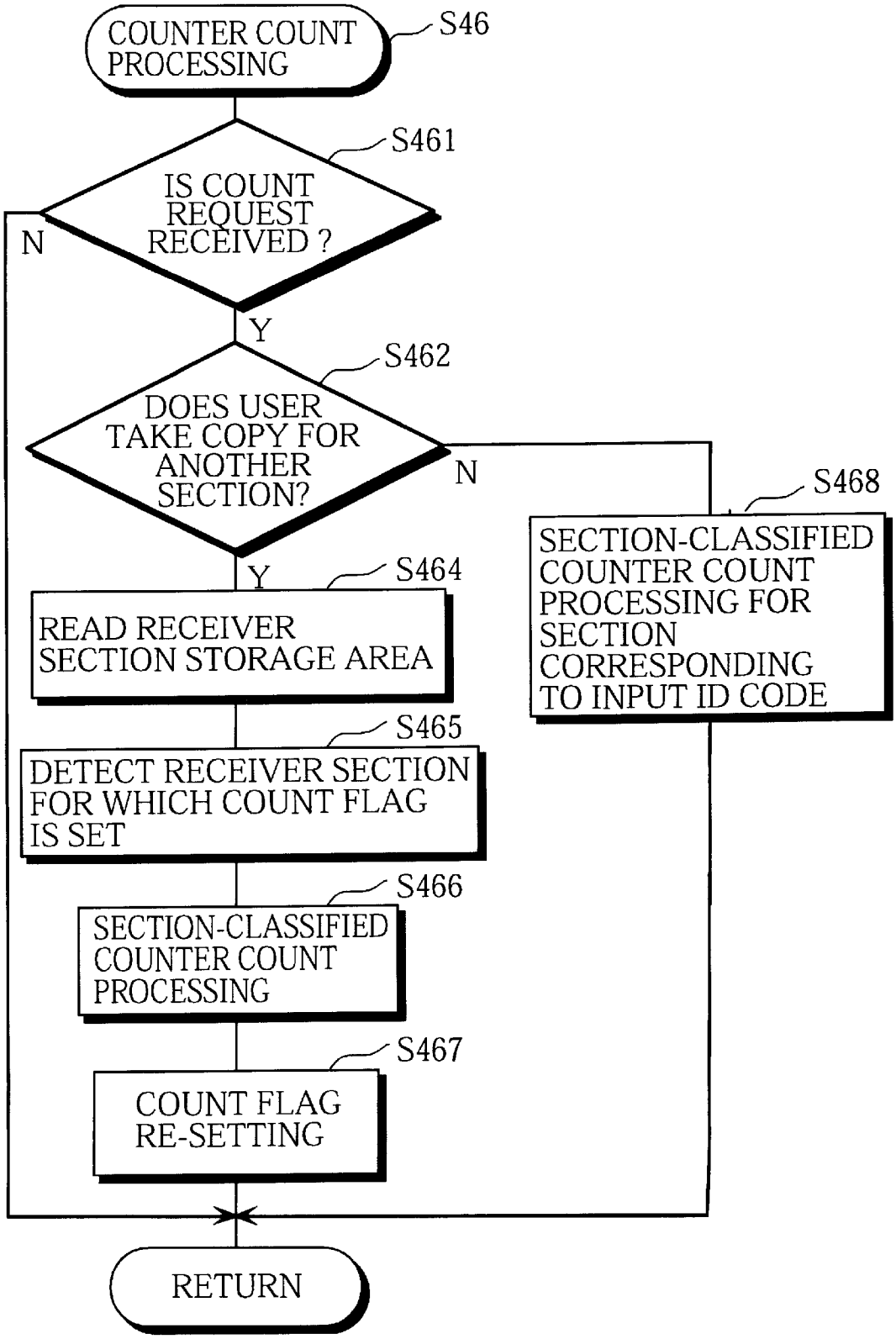
FIG. 16 is a flowchart showing the subroutine of the counter count processing (Step S46) in FIG. 7.

FIG. 16 is a flowchart showing the subroutine of the counter count processing (Step S46) in FIG. 7.

The CPU 91 judges whether a count request is received according to the exit of a recording sheet S (Step S461). The transport path of the copying machine 1 is provided with a sensor detecting the exit of a recording sheet S. A count request is transmitted from another CPU (not illustrated) to the CPU 91 according to a detection signal from the sensor.

On receiving a count request, the CPU 91 judges whether the "another section" key TP31 on the ID code input screen in FIG. 11 is ON (Step S462). If the "another section" key TP31 is ON, the CPU 91 reads the receiver section storage area α3 from the temporary RAM 93*a* (Step S464). The CPU 91 detects the receiver section for which the count flag is set (Step S465), and performs section classified counter count processing (Step S466) for having the section-classified counter of the receiver section count up.

If the section-classified counter count processing finishes for the receiver section for which the count flag is set, the CPU 91 performs count flag re-setting (Step S467). In the count flag re-setting, the CPU 91 finds the receiver section corresponding to the section number the value of which is the second smallest among the values of the section numbers of the selected receiver sections, and resets the count flag for the newly-found receiver section. The process returns to Step S46.

By repeating these operations, the CPU 91 counts the number of copying operations for each receiver section in order.

If no count request is received at Step S461, the process returns to Step S46.

When all the copying operations for receiver sections are finished, the storage areas in the main RAM 93*b* of the sections are searched for based on the section numbers of the receiver sections. The counted value by the section-classified counter of each receiver section in the temporary RAM 93*a* is cumulatively counted by the counter in the corresponding storage area in the main RAM 93*b*, and the counted value is stored in the storage area.

If the "another section" key TP31 is not ON, i.e., if the "present section" key TP32 is ON at Step S462, the section-classified counter count processing is performed for the section corresponding to the user section ID that the user has been input (Step S468). The process returns to Step S46. The number of the copying operations related to the user section is counted by the section-classified counter for the user section. When all the copying operations for the user section are finished, the counted value by the section-classified counter in the temporary RAM 93*a* is cumulatively counted by the counter in the storage area of the user section in the main RAM 93*b*, and the counted value is stored in the storage area.

(4) Other Embodiments

An image forming management device according to the present invention has been described based on an embodiment. The present invention is not limited to the above-described embodiment. The following is other embodiments of the present invention.

1̂ While a section ID is input using 10-key pad 82 in the above-described embodiment, it is possible to record the information on a section ID on a magnetic card and to have a card reader that the copying machine 1 is provided with read the information on the magnetic card.

2̂ In the above-described embodiment, when all the copying operations for receiver sections are finished, the storage areas in the main RAM 93*b* of the receiver sections are searched for based on the section numbers of the receiver sections. The counted value by the section-classified counter of each receiver section in the temporary RAM 93*a* is cumulatively counted by the counter in the corresponding storage area in the main RAM 93*b*, and the counted value is stored in the storage area. It is possible to store the number of copying operations for each receiver section in the counter area $\alpha 4$ in the storage area of each user section in the main RAM 93*b* and to accumulate and store the copying operations for each receiver section in the storage area of each receiver section in the main RAM 93*b* regularly.

3̂ While the management of the number of copying operations by a copying machine has been described in the above-described embodiment, it is possible to apply the present invention to the management of the number of image formations by another image forming apparatus, for instance, a laser printer.

Although the present invention has been fully described by way of examples with reference to the accompanying drawings, it is to be noted that various changes and modifications will be apparent to those skilled in the art. Therefore, unless such changes and modifications depart from the scope of the present invention, they should by construed as being included therein.

What is claimed is:

1. An image forming management apparatus that manages image formations by an image forming apparatus, comprising:

a memory for storing (1) a plurality of identifiers each of which corresponds to a different group in a plurality of groups, and (2) a plurality of information that are related to one of the plurality of identifiers, each of the information representing one group that differs from a group corresponding to a related identifier;

an identifier reception unit for receiving input of an identifier;

a display unit for displaying a plurality of information stored in the memory;

a selection unit for selecting at least one of the information from the plurality of information that the display unit displays; and a processor for having the display unit display a plurality of information that are stored in the memory and are related to the identifier received by the identifier reception unit, for receiving at least one of the information selected with the selection unit among the plurality of information displayed by the display unit, for counting the number of image formations made by the image forming apparatus, and for storing the counted number in the memory relating to each group corresponding to each of the information selected with the selection unit.

2. The image forming management apparatus according to claim 1, wherein the processor sets a number of the information selected with the selection unit as a number of image formations to be made for a page by the image forming apparatus.

3. The image forming management apparatus according to claim 1, wherein the processor has the display unit display the plurality of information that are stored in the memory and are related to the identifier received by the identifier reception unit as a list.

4. The image forming management apparatus according to claim 1, wherein the memory includes a plurality of storage areas, each of which stores an identifier corresponding to a group, a number of image formations that have been made for the group, and a plurality of information each of which represents one group that differs from the group.

5. An image forming apparatus, comprising:

an image forming unit for forming an image on a recording sheet;

a memory for storing (1) a plurality of identifiers each of which corresponds to a different group in a plurality of groups, and (2) a plurality of information that are related to one of the plurality of identifiers, each of the information representing one group that differs from a group corresponding to a related identifier;

an identifier reception unit for receiving input of an identifier;

a display unit for displaying a plurality of information stored in the memory;

a selection unit for selecting at least one of the information from the plurality of information that the display unit displays; and a processor for having the display unit display a plurality of information that are stored in the memory and are related to the identifier received by the identifier reception unit, for receiving at least one information selected with the selection unit among the plurality of information displayed by the display unit, for activating the image forming unit, for counting the number of image formations made by the image forming unit, and for storing the counted number in the memory relating to each group corresponding to each of the information selected with the selection unit.

6. The image forming apparatus according to claim 5, wherein the processor sets a number of the information selected with the selection unit as a number of image formations to be made for a page by the image forming unit.

7. The image forming apparatus according to claim 5, wherein the processor has the display unit display the plurality of information that are stored in the memory and are related to the identifier received by the identifier reception unit as a list.

8. The image forming apparatus according to claim 5, wherein the memory includes a plurality of storage areas, each of which stores an identifier corresponding to a group, a number of image formations that have been made for the group, and a plurality of information each of which represents one group that differs from the group.

9. An image forming management method that manages image formations by image forming apparatus, comprising:

a first step for storing an identifier for each of a plurality of groups in a memory;

a second step for storing a plurality of information related to an identifier for each identifier, each of the information representing one group that differs from a group corresponding to a related identifier;

a third step for receiving input of an identifier;

a fourth step for displaying a plurality of information that are stored in the memory and are related to the received identifier on a display unit;

a fifth step for receiving at least one of the information from the plurality of information displayed on the display unit;

a sixth step for having the image forming apparatus perform image formations; and a seventh step for counting a number of image formations by the image forming apparatus and for storing the counted number in the memory relating to each group corresponding to the information received at the fifth step.

10. The image forming management method according to claim 9, wherein at the fourth step, the plurality of information that are stored in the memory and are related to the received identifier are displayed as a list on a display unit.

11. The image forming management method according to claim 9, wherein the fifth step further includes a step for setting a number of received information as a number of image formations to be made for a page by the image forming apparatus.

12. The image forming management method according to claim 9, wherein the memory has a plurality of storage areas, each of which stores an identifier for a group, and, at the second step, stores a plurality of information related to an identifier in a same storage area as the identifier for each identifier.

13. The image forming management method according to claim 9, wherein the memory has a plurality of storage areas, each of which stores an identifier for a group, and stores the number of image formations counted at the seventh step for each group corresponding to each of the information received at the fifth step in each storage area that stores an identifier representing a group corresponding to a received information.

* * * * *